United States Patent [19]

Maurino et al.

[11] 4,027,723

[45] June 7, 1977

[54] MOLDING APPARATUS INCLUDING A FLEXIBLE MOLD FOR MAKING ARTICLES HAVING RADIALLY INWARDLY EXTENDING PROJECTIONS ON AN INTERIOR SURFACE

[75] Inventors: William J. Maurino; Raymond M. Putzer, both of Racine, Wis.

[73] Assignee: Precision Flexmold, Inc., Racine, Wis.

[22] Filed: Jan. 20, 1975

[21] Appl. No.: 542,215

[52] U.S. Cl. ..... 164/213; 164/7; 164/187; 164/245; 164/253; 425/437; 164/401

[51] Int. Cl.[2] ..... B22C 17/00; B22C 7/00

[58] Field of Search ..... 164/7, 40, 44, 165, 164/213, 245, 253, 187, 170, 403, 401; 249/65, 152, 153; 425/437

[56] References Cited

UNITED STATES PATENTS

| | | | |
|---|---|---|---|
| 925,249 | 6/1909 | Taylor et al. | 164/40 |
| 1,021,349 | 3/1912 | Bryant | 164/170 |
| 2,491,146 | 12/1949 | Zohn | 164/245 |
| 2,903,762 | 9/1959 | Candron | 164/40 X |
| 3,257,690 | 6/1966 | Scott | 249/65 X |
| 3,642,975 | 2/1972 | Duggins et al. | 249/65 X |
| 3,822,106 | 7/1974 | Bonet Sirera | 249/65 X |
| 3,830,279 | 8/1974 | Arbenz et al. | 164/253 X |

*Primary Examiner*—Ronald J. Shore
*Attorney, Agent, or Firm*—James E. Nilles

[57] ABSTRACT

Apparatus for molding, for example, a seamless brake drum female mold having a plurality of radially inwardly extending grooves and ridges. The apparatus includes a generally hollow one-piece distensible and flexible hollow male mold having an annular side wall having a plurality of radially extending projections and undercuts and includes an outer core box positioned around the flexible mold and defining an annular cavity with it. The apparatus further comprises a packing mandrel for supporting the hollow flexible mold while mold material is packed around it and a vacuum mandrel to be inserted within the flexible mold to cause the collapse of the flexible mold so that the molded article can be lifted off the flexible mold despite the radially extending projections.

3 Claims, 4 Drawing Figures

MOLDING APPARATUS INCLUDING A FLEXIBLE MOLD FOR MAKING ARTICLES HAVING RADIALLY INWARDLY EXTENDING PROJECTIONS ON AN INTERIOR SURFACE

SUMMARY OF THE INVENTION

The invention pertains to improvements in apparatus for making, for example, the female mold used in the casting of brake drums. The invention includes the use of a distensible flexible male mold member having a plurality of radially extending projections and undercuts for defining a plurality of radially inwardly extending grooves and ridges on the interior surface of the molded article. The male mold is constructed from a flexible mold material so that it can be caused to collapse radially inwardly with the application of vacuum. The radial collapse of the mold causes the projections to be withdrawn from the molded article in such a manner that there is a minimum or rubbing of the surfaces of the mold and molded article such that the grooves and ridges formed on the inside surface of the molded article are accurately defined.

The method of molding using the flexible male mold generally requires the use of a core box and two mandrels, a packing mandrel and a vacuum mandrel. Initially the flexible male mold is placed on the packing mandrel for support and the core box is then placed around the flexible mold to define an annular mold cavity between them. The molding material is then packed into the mold cavity. The mandrel and the core box are removed and a smaller foraminous mandrel is then inserted within the inner cavity of the flexible mold replacing the first mandrel. The foraminous mandrel and the interior surface of the flexible mold define a space which allows the mold to collapse radially inwardly when vacuum is drawn in the space through the foraminous mandrel. With the flexible mold collapsed, the molded article can be easily removed. The flexible mold is caused to collapse radially by the vacuum thus withdrawing the projections from the molded article in such a manner that the projections and undercuts defined in the inner surface of the molded article are preserved. In this manner a molded surface having a substantial amount of definition can be formed.

By way of example, but not by way of limitation, the apparatus of this invention could be used with great advantage to mold an article composed of resin bonded sand to be used as a female mold into which molten metal could be poured for forming a brake drum, the brake drum having a plurality of outwardly extending projections on its exterior surface.

DESCRIPTION OF A PREFERRED EMBODIMENT

Figure 1:
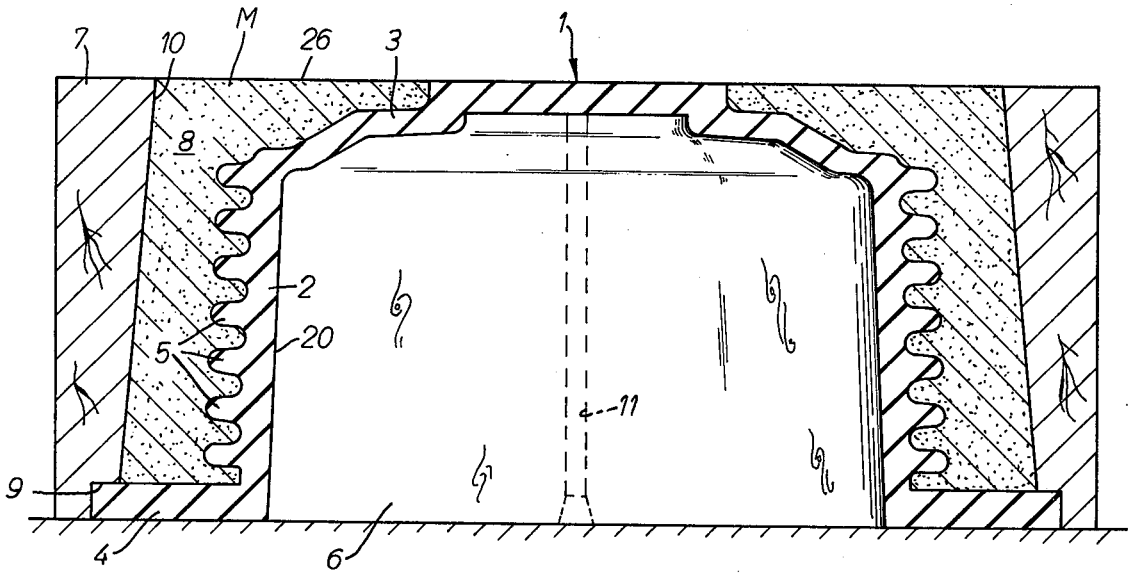
FIG. 1 is a vertical cross section view of the molding apparatus in accordance with the present invention including a flexible mold and a core box with molding material packed therebetween.

Generally, the present invention is concerned with the production of molded articles having radially inwardly extending grooves and ridges on an interior surface, for example, female molds used in casting brake drums. For molding such female molds the molding material may, for example, comprise resin bonded sand. However, various other types of materials may also be molded with the present invention and include plaster, cement, resins, paraffin, polyesters, epoxies, urethane foams, metals and other materials.

It has been found to be difficult, time consuming and expensive to mold articles which have a plurality of inwardly extending grooves and ridges on an interior surface. The present invention comprises molding such articles using apparatus including a flexible male mold which is radially inwardly collapsible. As an example of the difficulties faced in the molding art, in the manufacturing of brake drums, it is desirable to have increased cooling surfaces for maximum heat dissipation, and it is desirable therefore to have vanes or projections extending from the outer surface of the drum. The foundry sand molds used to cast these projections are difficult and expensive to make in traditional metal dies which require a plurality of separate metal pieces fitted together. The use of a plurality of such pieces not only is expensive to assemble and disassemble, but it results in an inferior mold having a plurality of seams. During the casting process a different gaseous action occurs at the seams than elsewhere and the resultant metallurgical quality of the casting differs at the seam areas relative to other areas of the casting. These differences set up stresses in the casting leading to problems of stress, corrosion, fatigue and failure.

The present invention overcomes these drawbacks by providing means to produce one-piece seamless foundry sand molds capable of molding articles having a plurality of radially extending projections and complementary undercuts and having superior metallurgical qualities and/or physical qualities. Furthermore, the present invention allows such molds to be molded in an efficient, inexpensive manner.

The apparatus of the present invention generally comprises a one-piece flexible mold which is deformable by the application of a fluid pressure differential thereby allowing the finished article to be released from the mold.

The flexible material used to comprise the flexible mold body may consist of any flexible mold material having elastomeric properties, the specific type of mold material used generally depending on the compatibility of the mold material with the materials molded. Materials having the desirable elastomeric properties include, for example, but not by way of limitation, polyvinyl chloride "Koragel" produced by B. F. Goodrich of Akron, Ohio, polysulphide cold molding compounds sold by Perma Flex of Columbus, Ohio; and the silastic RTV silicone rubber produced by Dow Corning and General Electric and methane elastomers.

The invention is shown in FIGS. 1 through 4 as including a generally hollow, one-piece distensible flexible male mold 1 having a main generally cylindrical side wall 2, an end wall 3, and an outer annular flange 4. Extending radially outwardly from the side wall 2 are a plurality of projections 5 spaced vertically and circumferentially (annularly). The flexible mold 1 is of such wall thickness that it is generally self-supporting and capable of supporting without distortion the weight of the molding material M placed in the mold. During the process of packing the molding material M into the mold cavity, however, the flexible mold 1 is supported on a packing mandrel 6 to maintain the shape of the mold despite the added pressures caused during the filling and packing of the mold.

The molding apparatus also includes a rigid core box 7 which defines with the flexible mold 1 a generally annular mold cavity 8 which is filled with molding material M to form a molded article 26. FIGS. 1-4 show, as an example but not by way of limitation, a female mold 26 having a tapered side wall and an integrally formed bottom wall used in the casting of brake drums molded from a resin bonded sand molding material. The external surface of the flexible mold 1 results in the internal surface of the female mold 26 having a plurality of radially inwardly extending grooves and ridges. The core box 7 has a generally annular configuration and has generally smooth interior surface 10. The core box 7 may be made of wood or any of the other materials commonly used in the molding art. The core box 7 is centered with respect to flexible mold 1 by an undercut portion 9 which fits securely over the periphery of the flange 4 of the flexible mold 1 as shown in FIG. 1. With the core box 7 placed around the flexible mold the molding material M is packed into the mold cavity. The core box 7 and the packing mandrel 6 can then be removed.

Figure 2:
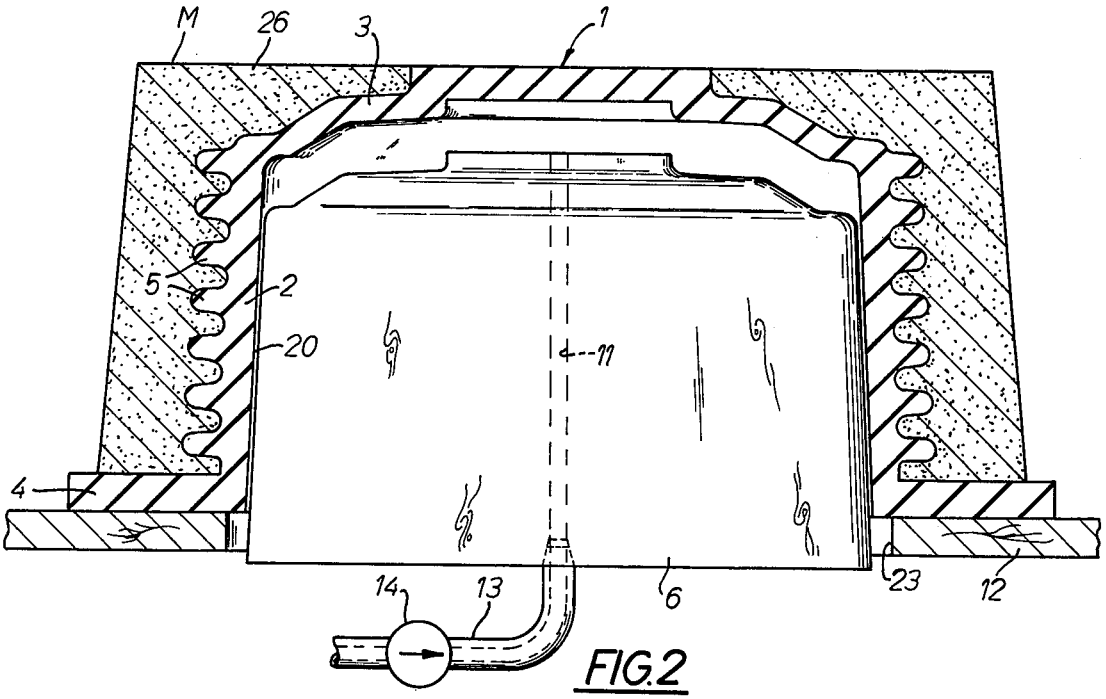
FIG. 2 is a vertical cross section view of the molding apparatus in accordance with the present invention showing the packing mandrel being removed from the flexible mold.

The step of removing the packing mandrel 6 from the flexible mold 1 is shown in FIG. 2. The packing mandrel 6 is provided with a central bore 11 which can be connected to a fluid conduit 13 and pump 14 such that fluid pressure may be forced between the mandrel 6 and the flexible mold 1. The mandrel is thus forced downwardly by the fluid pressure out of the flexible mold 1 through aperture 23 in the support plate 12.

Figure 3:
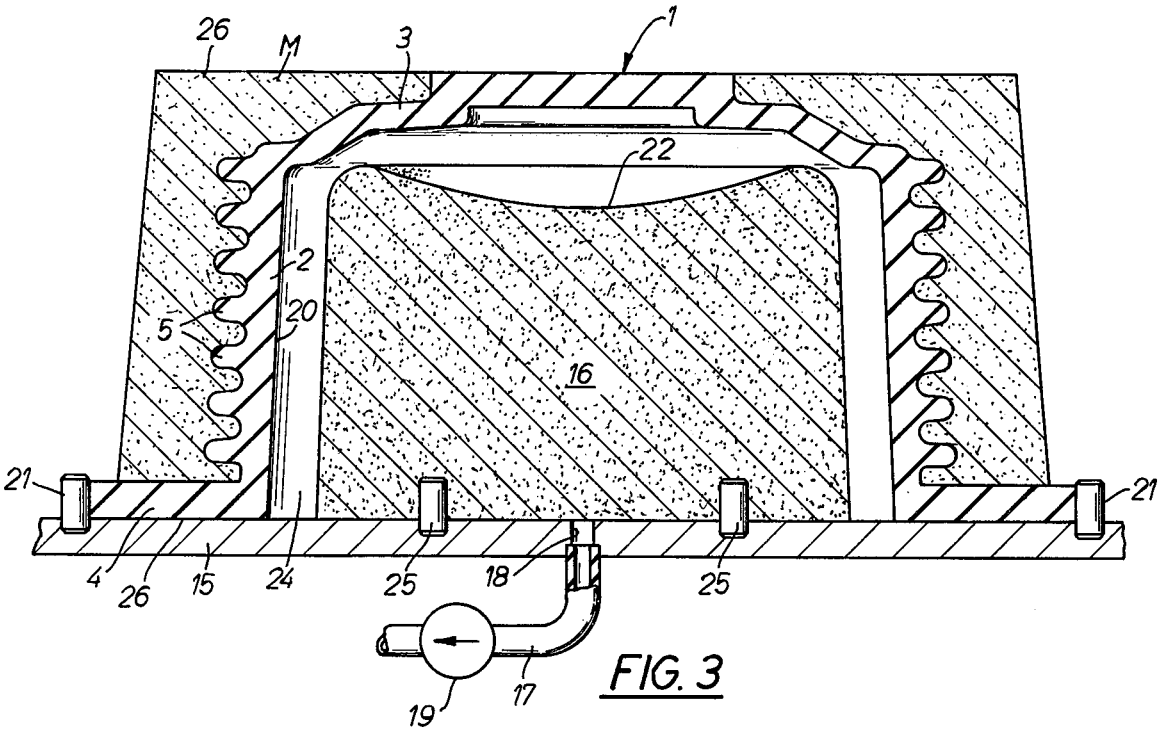
FIG. 3 is a vertical cross section view of the molding apparatus in accordance with the present invention and showing the vacuum mandrel spaced within the flexible mold.

Then, as shown in FIG. 3, the flexible mold 1 and the molded article 26 such as the female mold 26 may be placed on a vacuum plate 15 which supports an upwardly projecting foraminous or porous mandrel 16. The mandrel is connected by way of a conduit 17 and bore 18 to a vacuum pump 19. The mandrel is fixedly positioned on the plate by means of pins 25 which extend from the plate and into cooperating bores in the mandrel. The flexible mold is positioned on the plate by means of a plurality of aligning pins 21 which abut the periphery of the flange 4 such that a cavity 24 is formed between the mandrel 16 and the inside surface 20 of the mold. It is necessary to have such positioning means 21 and 25 to accurately maintain the gap between the mold and the mandrel.

The flange 4 of the flexible mold has a flat bottom surface 26 which abuts in sealing relationship the upper surface of the vacuum plate 15 such that a vacuum may be drawn in the cavity 24. The seal between the flange 4 and the plate 15 is stengthened by the weight of the molded article 26 on the upper surface of the flange 4 and by the large surface area of the flange.

Figure 4:
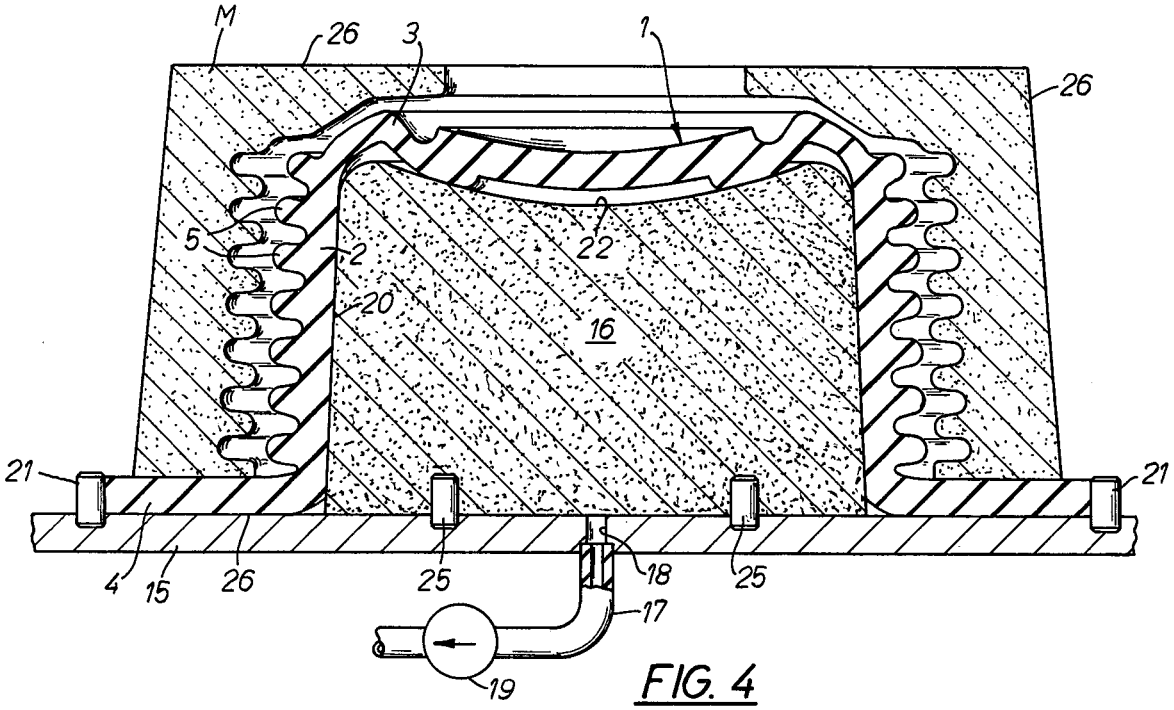
FIG. 4 is a view similar to FIG. 3, but showing the flexible mold in the collapsed state when the vacuum is applied.

When vacuum is drawn in the cavity 24 through the foraminous mandrel 16, as shown in FIG. 4, atmospheric pressure acting on the end wall 3 of the flexible mold 1 forces it to collapse downwardly against the concave surface 22 of the mandrel 16. The upper portion of the side wall 2 of the flexible mold 1 is thus pulled radially inwardly creating a gap between the side wall 2 and the inside surface of the female mold 26. The air pressure filling this gap then causes further radial collapse of the flexible mold 1 thereby withdrawing the projections 5 of the flexible mold radially out of the grooves formed in the female mold 26. This means of withdrawing the mold projections radially inwardly from the grooves formed in the molded article results in accurately formed grooves and ridges in the finished molded article having substantial definition.

Though the mold material is flexible it is difficult to cause it to collapse uniformly in the radial direction because it has a tendency to assume a shape having an oblong or ellipitcal cross section. The present invention avoids this problem in that the diameter of the foraminous mandrel is large enough so as to prevent any part of the flexible mold from collapsing too far inwardly but sufficiently small with respect to the inside surface of the flexible mold as to allow the mold to collapse far enough radially to pull the projections 5 completely out of the grooves formed in the molded article so that it can be freely removed.

The purpose of constructing the mandrel 16 of a foraminous material is to ensure that the flexible mold collapses radially. If the vacuum mandrel 16 has only a few passages through it, when the flexible mold collapses inwardly it could collapse against those vacuum passages sealing them and preventing uniform collapse of the mold. The mandrel could also be constructed of a nonporous material having a plurality of passages extending through it provided that the number of passages is sufficient to maintain a source of vacuum to the vacuum chamber.

When the flexible mold has collapsed and the projections have been pulled out of the undercuts formed in the article, the finished article may be freely pulled upwardly away from the mold. Once the molded article, i.e., the female mold 26, has been removed from the mold 1, the vacuum is released and the mold 1 may be used again in a like process.

RESUME

The present invention provides a novel apparatus for economically forming articles having radially inwardly extending grooves and ridges on an interior surface. The invention provides m means for rapidly and economically forming accurately defined radially extending grooves and ridges on the internal surface of a mold using a distensible flexible mold member and means for causing it to radially contract. The present invention is a substantial advance over the prior art in that it markedly decreases the cost of mold making and production and increases the quality of molded articles having such undercuts and projections.

We claim:

1. Apparatus for molding a generally hollow and seamless article having undercut portions comprising a one-piece distensible and flexible hollow male mold having a generally cylindrical side wall having a plurality of radially outwardly extending annular projections for defining radially inwardly extending grooves and ridges on the inside surface of an article molded thereon, said flexible mold also having an end wall extending across one end of said side wall such that said mold defines a generally cylindrical cavity, said male mold also having an annular radial flange extending outwardly from said side wall and at an end thereof which is opposite from said end wall, a mandrel receivable in said generally cylindrical cavity and defining a generally annular vacuum chamber with said mold, plate means extending across and abutting against said flange and said mandrel for removably supporting said mold and mandrel and having a sealing engagement therebetween, aligning means between said plate means and said mold flange and said mandrel for accurately but removably locating said mold and mandrel on said plate means, said mandrel being foraminous such that a vacuum may be drawn evenly through said mandrel for insuring radially inward collapse of the flexible mold, said plate means having a fluid pressure connection to a source of vacuum such that a vacuum may be drawn through said plate means and said mandrel and from said annular vacuum chamber to cause said mold to contract radially inwardly to release a molded article from around said mold.

2. The apparatus set forth in claim 1 including a core box around said mold and defining a molding cavity therewith into which mold material may be inserted, said core box also having a sealing engagement with said mold flange and for being centered with respect to said mold.

3. The apparatus set forth in claim 1 further characterized in that said flexible mold is of such wall thickness that it is self-supporting and supports the weight of the material placed therearound in said mold cavity without distortion of said mold side wall.

* * * * *